United States Patent [19]

List

[11] Patent Number: 4,729,324

[45] Date of Patent: Mar. 8, 1988

[54] MULTIPLE AXLE SELF-STEERING POWERED LOCOMOTIVE TRUCK

[76] Inventor: Harold A. List, 38 W. University Ave., Bethlehem, Pa. 18015

[21] Appl. No.: 873,291

[22] Filed: Jun. 5, 1986

Related U.S. Application Data

[63] Continuation of Ser. No. 422,609, Sep. 24, 1982, abandoned, which is a continuation-in-part of Ser. No. 948,878, Oct. 5, 1978, Pat. No. 4,455,946, which is a continuation-in-part of Ser. No. 608,596, Aug. 28, 1975, Pat. No. 4,131,069, which is a continuation-in-part of Ser. No. 438,334, Jan. 31, 1974, abandoned.

[51] Int. Cl.[4] ..... B61F 5/38

[52] U.S. Cl. ..... 105/168; 105/138; 188/53

[58] Field of Search ..... 105/168, 133, 135, 136, 105/138, 165, 167; 188/52–55; 291/1, 401.1

[56] References Cited

U.S. PATENT DOCUMENTS

| | | | |
|---|---|---|---|
| 133,001 | 11/1872 | Youmans | 105/168 |
| 452,035 | 5/1891 | Short | 105/135 X |
| 473,090 | 4/1892 | Seibert | 291/1 |
| 843,261 | 2/1907 | Conaty | 105/165 X |
| 894,342 | 7/1908 | Peckman | 105/165 |
| 956,900 | 5/1910 | Knobbs | 105/168 |
| 1,074,479 | 9/1913 | Towle | 105/165 |
| 1,218,720 | 3/1917 | Tomlinson | 188/53 |
| 2,245,333 | 6/1941 | Frei | 105/168 |
| 2,834,303 | 5/1958 | Furrer | 105/168 X |
| 4,167,906 | 9/1979 | Steinman et al. | 105/168 |
| 4,353,309 | 10/1982 | Pollard et al. | 105/136 |
| 4,458,604 | 7/1984 | Cope | 105/168 |

FOREIGN PATENT DOCUMENTS

| | | | |
|---|---|---|---|
| 2630353 | 1/1977 | Fed. Rep. of Germany | 105/168 |
| 27334 | of 1911 | United Kingdom | 105/165 |

*Primary Examiner*—Robert B. Reeves
*Assistant Examiner*—Glenn B. Foster
*Attorney, Agent, or Firm*—Kenneth P. Synnestvedt

[57] ABSTRACT

A powered locomotive truck is disclosed, the truck having two wheelsets, each with an axle having a driving motor mounted thereon, the wheelsets being mounted in a rigid main truck frame, with freedom for relative yaw motion of the wheelsets, and each wheelset further having a steering arm or yoke movable with its wheelset during relative yaw motion of the wheelsets with respect to each other, the steering arms having an interconnection in a region between the wheelsets providing for interchange of yawing steering forces between the wheelsets.

3 Claims, 7 Drawing Figures

MULTIPLE AXLE SELF-STEERING POWERED LOCOMOTIVE TRUCK

CROSS REFERENCES

The present application is a continuation of co-pending application Ser. No. 422,609, filed Sept. 24, 1982, now abandoned, which application is a continuation-in-part of application Ser. No. 948,878, filed Oct. 5, 1978 issued June 26, 1984 as U.S. Pat. No. 4,455,946, which, in turn, is a continuation-in-part of my prior application Ser. No. 608,596, filed Aug. 28, 1975, and which issued Dec. 26, 1978, as U.S. Pat. No. 4,131,069, which is a continuation-in-part of my prior application Ser. No. 438,334, filed Jan. 31, 1974, now abandoned.

BACKGROUND AND STATEMENT OF OBJECTS

Certain forms of multiple axle self-steering railway trucks are known, particularly for use in railway cars. Several forms of such self-steering car trucks are disclosed in the above identified prior applications. The truck arrangements disclosed in my prior applications comprise a pair of axled wheelsets mounted in a truck frame structure with freedom for relative yaw motion of the axles and each axled wheelset having a steering arm, with the two steering arms interconnected in a region between the axles to provide for interchange of steering forces between the steering arms and thus provide for interchange of steering forces between the wheelsets in the yawing sense.

In said prior applications, arrangements are shown in which the devices which interconnect the steering arms are arranged to interchange the steering forces between the steering arms and the wheelsets independently of yaw-inducing connection with the main frame or other parts of the truck structure. The foregoing provides self-steering action of such effectiveness and accuracy as to virtually eliminate the angle of attact between the wheel flanges and the rails on which the truck is travelling. Smoother tracking is thereby provided under all conditions. This greatly reduces noise and wear between the wheels and rails in curves, improves high speed stability and ride quality with reduced maintenance of the track, trucks and car structure.

One of the principal objectives of the present invention is to provide a self-steering action of the character just referred to in a powered truck of a locomotive and to adapt this self-steering character to the powered truck of a locomotive in such a manner as to provide for effective delivery of the driving force from the driven wheelsets to the main frame of the truck and thus to the locomotive itself, notwithstanding the freedom provided for the self-steering activity of the wheelsets in the yawing sense.

Another objective of the present invention is to provide a novel arrangement of brakes and brake parts for the driven wheels, the brake equipment being mounted at least in part on the main frame of the truck, but being arranged to accommodate yawing motions of the wheelsets even at times during the application of the brakes.

In one preferred embodiment according to the present invention, the powered truck incorporates two wheelsets, each provided with a steering arm and each of which wheelsets is independently motorized, i.e., the axle of each wheelset carries its own driving motor, and abutment means are provided for transmitting motor torque forces directly from the motor to the truck frame. In another embodiment abutment, means are provided for transmitting torque forces through the steering arms to the truck frame.

It is a further object of the present invention to provide a pivotal interconnection structure between the steering arms associated with each axle wheelset, the interconnection structure being arranged to transmit traction forces between the steering arms, provision also being made to transmit traction forces from the steering arms to the truck frame in various different relatively angled positions of the steering arms.

In summary of the foregoing and of other features of the present invention, it will be seen that it is a general objective of this invention to improve the tracking behavior of railway locomotive trucks, particularly a two-axle or two-wheelset truck. Such improvement in the tracking behavior increases the adhesion available for traction and further reduces the flange forces and thus the wear on both the wheels and the track not only in curves but also on straight track.

Prior art or conventional powered trucks exert lateral forces on the track which are generally much greater than those required to guide the vehicle along the track centerline. In curves, most of the extra lateral force is the result of tracking errors for the leading axle which, in conventional trucks, is restrained to remain parallel with the trailing axle, in consequence of which, the leading axle will have a substantial angle of attack with respect to the rail in the yawing sense. This angle of attack not only creates unnecessary lateral force, but also causes a substantial loss of potentially available longitudinal adhesion for pulling the train. In curves, additional dynamic forces result from the fact that the leading axle, having a large angle of attack, will tend to follow, in detail, all the irregularities present in the alignment of the rails.

The foregoing disadvantages are virtually eliminated by the provision of the self-steering arrangement for a powered truck as provided in accordance with the present invention.

In prior art powered trucks operating on straight track, there are unnecessary lateral forces arising from unneeded steering action, which lateral forces can be of sufficient magnitude to cause wheel flange-to-rail impact, and such impacts have commonly occurred at a frequency approximating 2 to 5 impacts per second. These undesirable motions have arisen with conventional powered trucks in which the axles, while remaining generally parallel to each other, can move individually with substantially no restraint within the longitudinal and lateral clearances present in the mounting of the axle-bearing structures in the pedestal jaws of the truck frame.

The self-steering type of powered truck of the present invention eliminates the unnecessary lateral motions and forces above referred to.

The arrangement of the present invention is adapted for use in powered trucks having axle-hung traction motors. This type of powered truck is especially subject to tracking errors induced by the combination of pedestal jaw clearances and the lateral forces acting at the motor nose. The pedestal clearances allow lateral motion of the truck frame relative to the axle. This motion causes an undesirable yaw motion of the motor/axle assembly through the lateral force at the motor nose which is located longitudinally a substantial distance from the axle.

The arrangement of the present invention is effective in providing self-steering even with axle-hung traction motors. The reason for this is that the motor/axle assembly is firmly guided in yaw by the steering arms within the lost motion of the pedestal clearances. Further, in one embodiment, the motor nose is supported directly by the steering arm, completely eliminating all influence of lateral motor nose forces.

Although it is theoretically possible to support the traction motors from the vehicle body or truck frame instead of from the axles, and provide a flexible coupling in the drive train between the motor and the axles, this approach introduces the mechanical complexity of the flexible coupling and this is a substantial structural drawback. On the other hand, the arrangement of the present invention provides the opportunity to support the traction motors from the steering arms. This greatly reduces the motions imposed on the flexible coupling, making this a much more attractive option for removing the traction motor from the unsprung axle weight category.

In summary, it is pointed out that the arrangements of the present invention effectively provide for steering motions of the powered axles which minimize the wheel/rail angle of attack in curves and also provide a stabilizing restraint of undesirable axle activity on straight track.

In accordance with the present invention, the vertical load-carrying connection between the truck framing and the axles has flexibility in the longitudinal direction to allow for yaw motion of the axles relative to the framing. The interconnection between the steering arms is arranged in a region midway between the two axles of a two-axle powered truck; and according to the present invention, this interconnection provides for interchange of lateral, vertical and longitudinal forces between the two axles, without significantly restraining the relative yaw motion as required in order to permit the axles to assume radial positions with respect to curved track. The interconnection also serves to transmit yaw forces from one wheelset to the other. At the same time, in accordance with the present invention, the interconnection between the steering arms provides a relatively stiff restraint of differential steering motion such as would be required for the two axles to assume positions corresponding to the sides of a non-rectangular parallelogram; and this restraint is of importance in order to provide high-speed stability on straight track.

The foregoing factors are of special importance in a powered truck of a locomotive, because preventing the wheel/rail angle of attack associated with tracking errors causes a consequent increase in the overall adhesion and thus in the utilization of the available power of the driving motors.

It is also a major objective of the present invention to provide for the retrofitting of certain existing powered trucks by adding steering arms and other related equipment to provide the operating advantages above referred to.

BRIEF DESCRIPTION OF THE DRAWINGS

How the foregoing objects and advantages are attained, together with others which will occur to those skilled in the art, will appear more fully from the following description taken with the accompanying drawings, in which.

The embodiment illustrated in FIGS. 1, 2, 3 and 4 represents a form of a powered truck, the general arrangement of which is known, being a conventional truck manufactured by General Motors Corporation, and these figures illustrate that truck retrofitted to incorporate one embodiment of the structure of the present invention.

Figure 5:
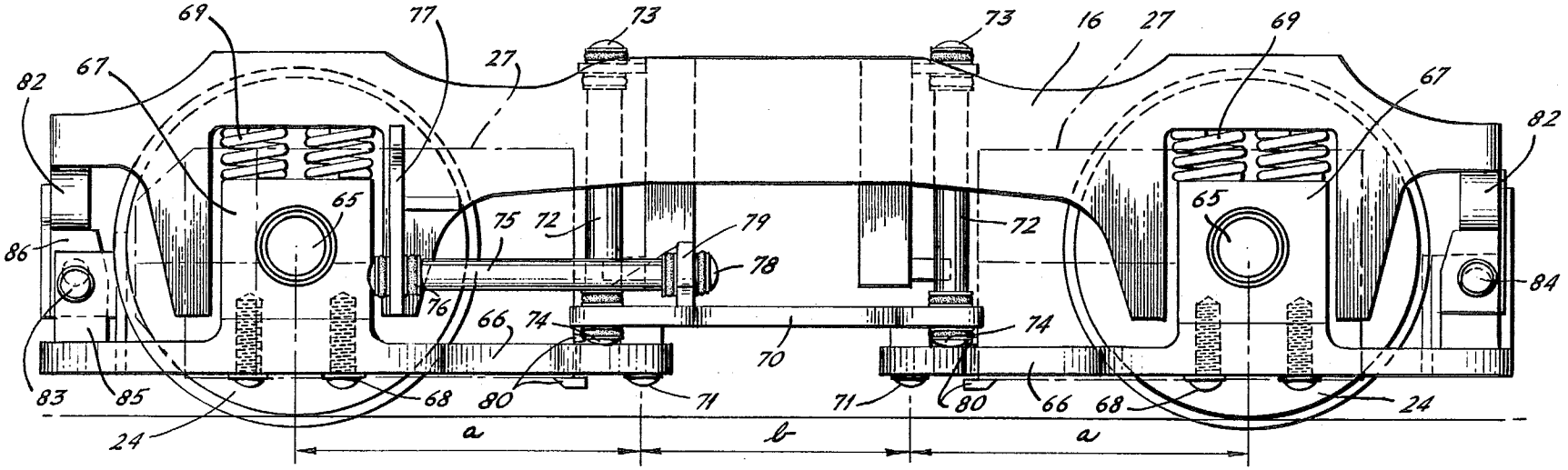
FIG. 5 is a somewhat diagrammatic elevational outline view of another embodiment of the equipment of the present invention applied to a powered truck in order to establish self-steering in the yaw sense.
Figure 6:
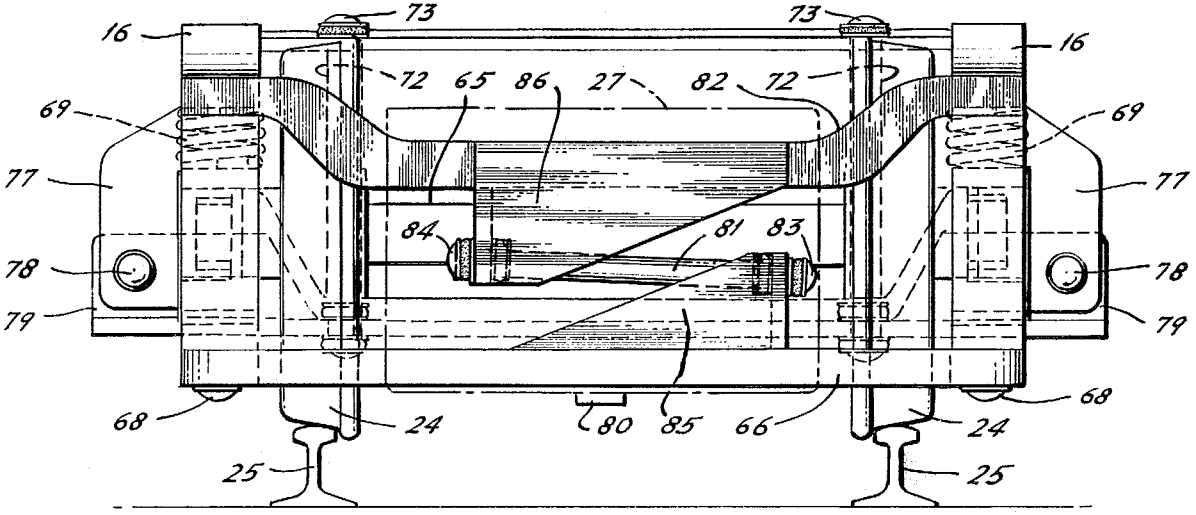
FIG. 6 is an end view of the truck of FIG. 5.
Figure 7:
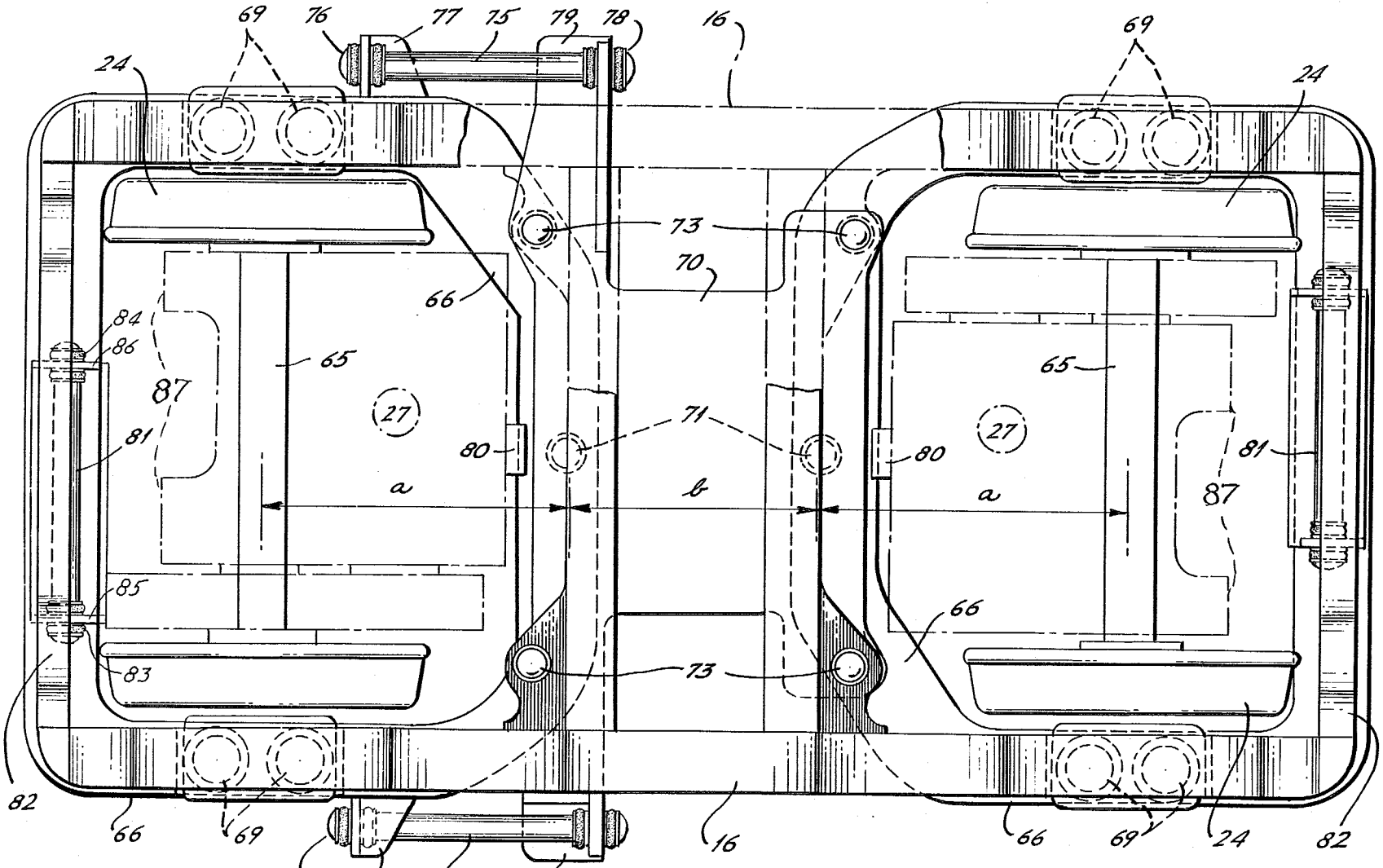
FIG. 7 is a plan view of the truck of FIGS. 5 and 6, with certain parts broken away.

FIGS. 5, 6 and 7 diagrammatically illustrate the same form of truck but incorporating certain alternative structural embodiments of features of the present invention which may be incorporated in such a truck by retrofitting, or which may be embodied in a newly constructed truck.

DETAILED DESCRIPTION OF FIGS. 1 TO 4

The powered truck of FIGS. 1 to 4, as above mentioned, is a known general form of powered truck and embodies two axled wheelsets, each being provided with a separate driving motor mounted on the axle of that wheel-set. At least one such truck is adapted to be positioned under the body of the vehicle or locomotive, and the general arrangement of the principal parts of the truck are mentioned herebelow with reference to FIGS. 1 to 4 inclusive.

Figure 2:
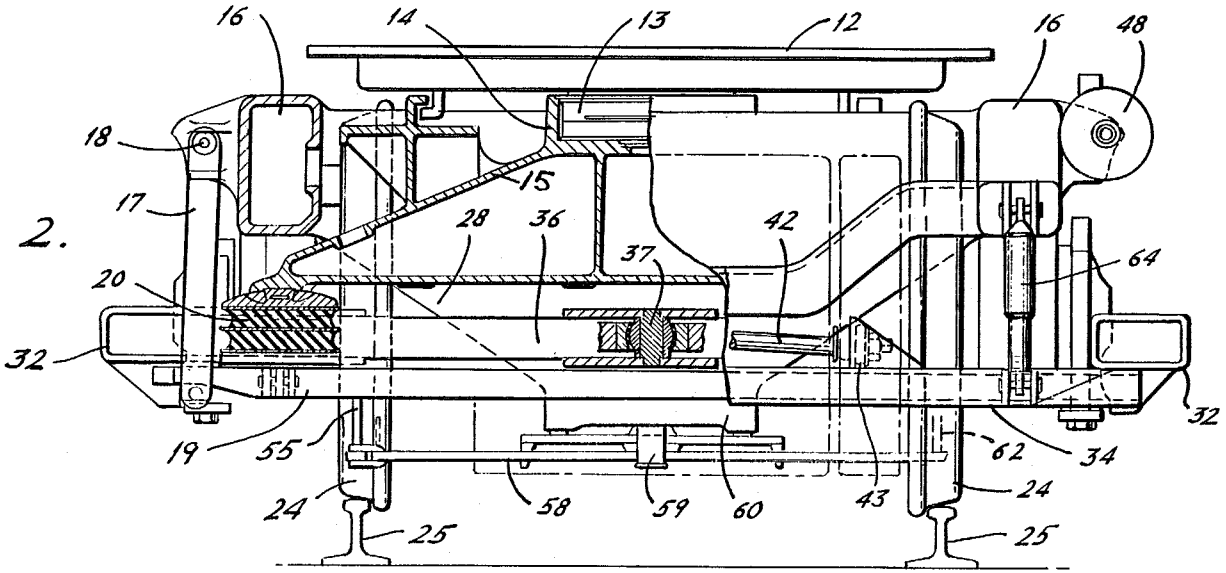
FIG. 2 is an end view of the truck of FIG. 1, with parts in the left hand portion of the view shown in vertical section.

In FIG. 2, a portion of the body of the locomotive appears at 12. The body of the locomotive is carried by the truck through a central pivot structure 13, received in an upwardly open socket 14 provided on the bolster 15.

The main frame structure of the truck comprises side frame elements 16, and the weight or load of the locomotive is transferred from the bolster 15 to the main side frame elements 16. For this purpose, a swing hanger yoke 17 at each side of the truck having upwardly projecting spaced legs is pivotally connected with one of the side frame elements at the points indicated at 18—18, and a spring plank 19 has its ends received on the base portions of the yokes 17 at opposite sides of the truck. Rubber or other resilient cushions 20 are interposed between the laterally projecting ends of the bolster 15 and the spring plank, so that the weight of the vehicle is transmitted from the bolster through the resilient cushions 20 to the spring plank and thence through the pivotal yokes 17 to the main side frame elements or members 16. The load is transferred from the side frames to the wheelsets in the manner brought out below.

In certain existing trucks of the general type disclosed in FIGS. 1 to 4, transversely extended leaf springs are positioned between the bolster 15 and the spring plank 19; and in such trucks, the retrofitting contemplated by the present invention includes, for example, replacing such leaf springs with rubber cushions of the type indicated at 20 in FIG. 2.

Each side frame member is provided with two pairs of pedestal jaws 21—21, each pair receiving the bearing structure 22 for the outboard portions of the axle of each wheelset. The bearing structures each comprise roller bearings in bearing boxes; but these parts form no part of the present invention per se and are, therefore, not illustrated in detail herein. Instead, the bearing structures are shown either in outline only, or for the wheelset toward the left of FIG. 4 by a diagrammatic horizontal sectional illustration.

Figure 1:
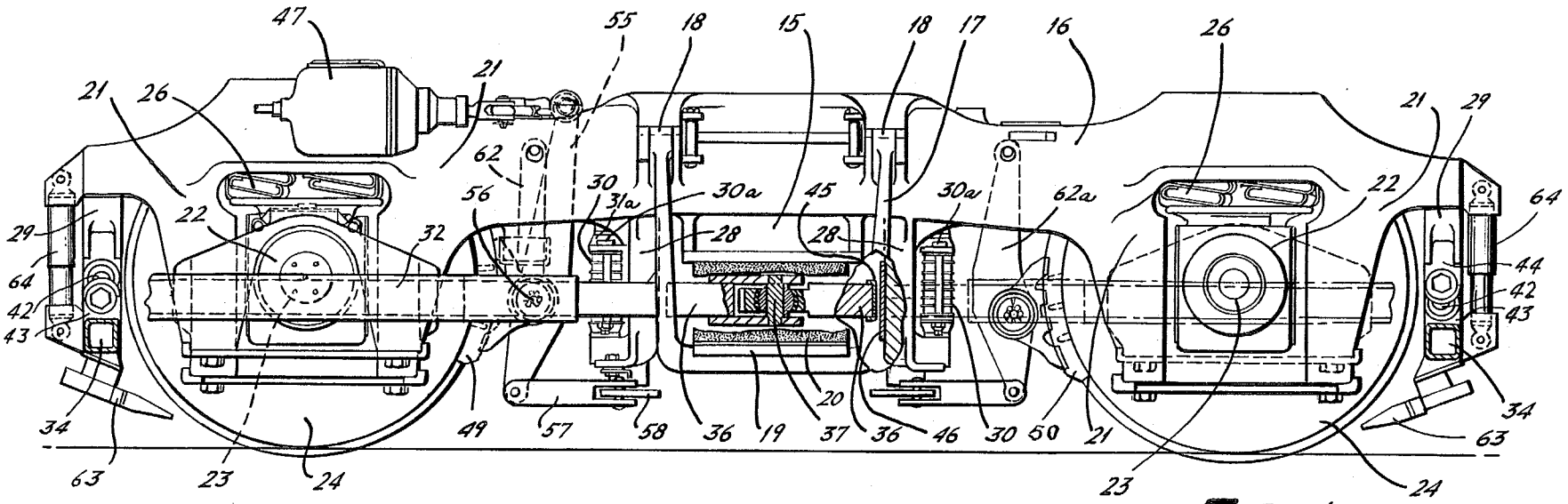
FIG. 1 is a side elevational view of a known form of powered truck to which the self-steering equipment of the present invention has been applied, portions of the structure being broken away and shown in section in the central region.

Each axle is, of course, located centrally in its bearing structure, for instance, in the region indicated at 23 in FIG. 1. A pair of wheels 24 is fixed on the axle of each wheelset, and these wheels are customarily flanged and arranged to travel upon rails, such as indicated at 25 in FIG. 2. At each bearing location, appropriate suspension springs 26 are provided through which the weight of the locomotive is transmitted from the side frame members to the bearing structures 22, and thence to the outboard end portions of the axle of each wheelset.

Between the wheels of each wheelset and mounted upon the axle of that wheelset, a driving motor and gearing are arranged, as diagrammatically indicated at 27. These motors are of known construction and are connected with the axle of the wheelset with which the motor is associated, and the details of that motor arrangement and connection are not described herein as they form no part of the present invention per se.

Figure 4:
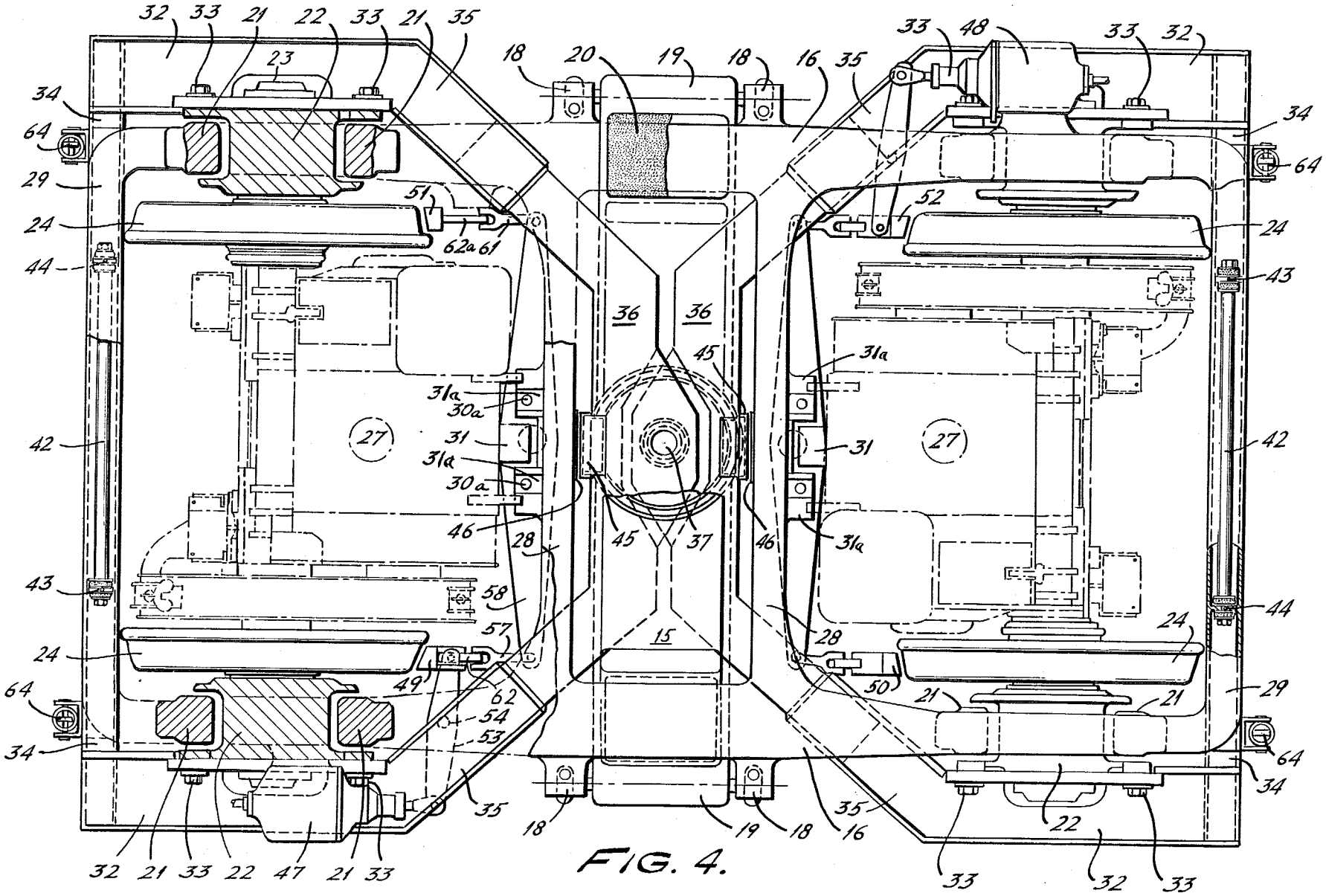
FIG. 4 is a plan view of the truck of FIGS. 1 to 3 but with certain portions broken away and shown diagrammatically in horizontal section.

As seen in FIGS. 1 and 4, a pair of transversely extending longitudinally spaced truck transoms 28 extend between the side frame members 16 in a portion of the truck structure in the mid region of the truck; and in addition, a transom 29 extends between the side frame members at each end of the truck. The side frame members and these transoms thus provide truck structure surrounding the region in which each wheelset and its motor are positioned. With the side frame members and the various transoms, it will be seen that the frame of the truck comprises a unified rigid structure, which is in contrast with many other railway railway car trucks, in which the trucks are provided with independent side frames capable of various motions with respect to each other. The interconnected rigid frame structure is customarily used in powered trucks of locomotives, especially where individual motors are provided on each of a plurality of wheelsets associated with the truck frame.

As appears in FIGS. 1 and 2, the motor associated with each wheelset is supported in part by certain interengaging motor nose suspension parts provided on the motor structure and on the adjoining transom 28. The transom 28 at each side of the central region carries a pair of motor nose cushion sandwiches 30 formed of interleaved rubber and metal layers located relative to the transom 28 by bolts **30*a*. Abutment lugs 31 and 31*a* project from the motor structure and transom respectively and serve to interchange torque forces between the motor and the transom 28 through the cushion sandwiches 30**. This motor nose suspension means is present on the truck being retrofitted.

The portions of the truck of the embodiment of FIGS. 1 to 4, as described above, are all included in the basic truck structure above referred to as manufactured by the General Motors Corporation; and it is a truck of that known construction which is adapted to be retrofitted according to the present invention in order to incorporate the self-steering features as applied to the motorized axles and wheelsets of that prior known truck. In carrying out the invention, it is, of course, also possible to apply the invention to a truck being newly built, without retrofitting an existing basic structure.

Attention is now directed to various features of the self-steering mechanisms incorporated in a truck according to the embodiment shown in FIGS. 1 to 4 inclusive, and it is here noted that certain new devices and structures are added to the equipment; and in addition, where retrofitting is being effected, certain of the existing components, for instance, the brake arrangements, are modified in order to provide effective brake operation in the self-steering type of powered truck contemplated according to the invention.

It is first noted that, as clearly appears in FIG. 4, substantial clearance is needed between the pedestal jaws 21 and the bearing structures 22 associated with each wheelset. This clearance provides freedom for relative angling or yawing of the wheelsets with respect to the main truck frame structure. In the case of retrofitting, the clearance may be provided by removing pedestal liners which are ordinarily present in such a truck. If desired, the pedestal liners may either be replaced with pedestal liners of smaller thickness, or the original liners may be ground to provide a thinner liner and, therefore, provide the required clearance. The liners are customarily of channel shape, in view of which removal thereof not only provides clearance in the fore-and-aft direction but also transversely of the truck. It is pointed out that the lateral movement restraint of certain roller-bearing arrangements normally provided by limiting the lateral pedestal clearance is provided in the arrangement of the present invention by the connection of the wheelsets to the steering arms described below.

The self-steering truck according to FIGS. 1 to 4, whether retrofitted or newly constructed, incorporates a "steering arm" for each wheelset. Herein, this term "steering arm" is used to identify the structure associated with each wheelset which is required in order to provide for the self-steering function; and it is to be understood that this structure may take a variety of different forms. Thus, it may comprise a transverse bar having an arm extended from each end toward the axle, or it may comprise a structure or yoke extended around the entire wheelset, as is the case in the illustration of FIGS. 1 to 4. Unless otherwise indicated, the term "steering arm" as used herein is to be understood in a generic sense.

Each of the steering arms comprises several different but interconnected structural pieces. Thus, a longitudinally extending channel or beam 32 extends fore-and-aft of the truck in the region of each bearing structure 22 and is secured to that bearing structure as indicated at 33. The outer ends of each pair of channel members 32 are interconnected by a transversely extending tube or brace 34. The yoke or steering arm for each wheelset further includes inwardly converging portions 35 which are interconnected by a transverse beam 36. The steering arm of this embodiment includes the parts identified by the reference numerals 32, 34, 35 and 36 thus constitutes a yoke completely surrounding each wheelset.

Figure 3:
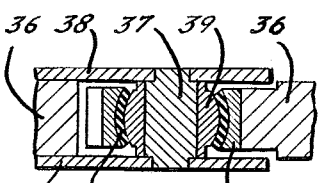
FIG. 3 is an enlarged vertical sectional view of the flexible joint or connection between two steering arms.

The two steering arms are interconnected by means of a pivot structure which is preferably located in the central region of the longitudinal and transverse axes of the truck. As best seen in FIG. 3, this interconnection between the transverse beams 36 and 36 of the two steering arms comprises a central vertical pin 37 which is mounted by means of plates 38 secured to one of the beams 36. The pin 37 serves to mount a central ball element 39, with its outer curved surface received in a socket 40 provided on the other transverse beam 36. A rubber or resilient liner 41 is provided between the spherical surfaces of the ball 39 and the socket 40; and as is clearly seen in the drawings, clearances are provided so that the interconnected steering arms for the two wheelsets may not only participate in relative yawing motions, but may also participate in other relative motions, including relative lateral and longitudinal tilting of the steering arms and thus of the wheelsets.

Since the side frames of this general type of truck structure are interconnected and the truck framing has rigidity, it becomes practical to employ a form of transverse link interconnection between the steering arms and the truck frame. This connection is arranged in a manner which will not interfere with the desired relative yawing motion of the two steering arms and the associated wheelsets. In the embodiment shown in FIGS. 1 to 4, the connection also constitutes a portion of the retrofitting equipment, in the event the arrangement is being applied to an existing truck. The connection comprises a generally transverse link 42 for each steering arm, the link having a connecting joint 43 at one end through which the link is connected with the steering arm, and also having a connecting joint 44 between the other end of the link and the cross transom member 29 of the truck frame. Preferably, each of the connecting joints is flexible to accommodate relative angling of the steering arms and truck frame structure. Desirably, these joints include resilient components to absorb minor relative motions and vibrations.

Because of the presence of these links, when the truck enters a curve and yawing forces are intercommunicated between the two steering arms through the interconnecting joint formed of the parts identified as 37 to 41, the relative yawing motion of the links is accommodated by a slight shifting movement of the interconnecting joint transversely of the truck. At the same time, because of the arrangement and characteristics of the interconnecting joint as above described, that joint will not only accommodate the relative yawing motion of the steering arms and thus of the wheelsets in the yawing sense, but will also accommodate other relative motions of the steering arms and wheelsets, particularly relative lateral and longitudinal tilting motions thereof. This form of transverse link interconnection between the truck frame having rigidly interconnected side frame members and the steering arm not only serves the functions referred to above, but is of particular importance in maintaining stability of operation at high speeds.

In accordance with the embodiment disclosed in FIGS. 1 to 4, special provision is made for interchange of the motor tractive forces from the steering arms to the truck frame, notwithstanding the relative yawing or steering of the axles. For this purpose, see particularly FIGS. 1 and 4, the cross beam 36 of each steering arm is provided with an abutment pad 45, being presented toward a cooperating pad 46 which is applied to the surface of the truck transom 28 presented toward the cross beam 36. As seen in FIG. 4, these abutment pads are provided at both sides of the central joint interconnecting the steering arms. Because of this arrangement, the tractive effort generated by the motor associated with a given wheelset will be communicated to the truck frame through the steering arm for that wheelset and thence through the pair of abutment pads 45 and 46. When the truck is being driven in one direction, for instance, toward the right when viewed as in FIG. 4, the tractive force generated by the motorized wheelset toward the left of FIG. 4 will be communicated through the steering arm for the left wheelset to and through the central interconnecting joint between the two steering arms and thence through the abutment pads 45 and 46 at the right hand side of the central joint. When the vehicle is being power driven in the opposite direction, the abutment pads 45 and 46 at the left of the central joint as viewed in FIG. 4, will receive the tractive force of both wheelsets and communicate that force to the truck frame through the transom 28 positioned at the left of the central joint.

It is contemplated that the abutment pads 45 and 46 be arranged to maintain surface-to-surface contact notwithstanding yawing as well as other angular motions of the steering arms. For this purpose, rubber pads may be used under the metal abutment pads. Alternatively, the abutment pads may be formed of a material having resilient characteristics as well as wear resistance. For this purpose, the pads may be formed of polyurethane.

A known truck of the general construction shown in FIGS. 1 to 4 also incorporates brake cylinders 47 and 48, one being mounted toward one end of the truck frame at one side thereof, and the other being mounted toward the other end of the truck frame toward the opposite end thereof, as clearly appears in FIG. 4. In a truck of the kind referred to and adapted to be retrofitted according to the present invention, the brake-applying cylinder 47 is provided with brake-operating links and levers extended to the two brake shoes 49 and 51 associated with the wheels 24 toward one end of the truck; and the other brake-applying cylinder 48 is provided with brake-operating links and levers extended to the two brake shoes 50 and 52 associated with the wheels 24 positioned toward the other end of the truck. Because of the introduction of the steering arms and the consequent steering motions between the two wheelsets, the present invention contemplates changing the brake rigging in order to provide for the application of the brake shoes 49 and 51 associated with one wheelset under the influence of one brake-applying cylinder 47; and in order to provide for the application of the brake shoes 50 and 52 associated with the other wheelset under the influence of the other brake-applying cylinder 48. The retrofitting to effect this change is desirable to limit the travel of the pistons in the brake-applying cylinders 47 and 48. The effective range of travel would be likely to be exceeded if the original brake rigging was retained in the truck modified to introduce the steering arms. However, with the retrofitted brake rigging arrangement, the brake cylinder travel is not increased by the steering or yawing motions of the wheelset.

The retrofit brake rigging may be of various kinds; but in a typical example, such as illustrated in FIGS. 1 to 4, the cylinder 47 is connected with a generally horizontal lever 53 pivoted on the top of the side frame of the truck as indicated at 54 in FIG. 4, the inner end of the lever 53 being flexibly connected with the upright lever 55 (see FIG. 1) on which the brake shoe 49 is mounted by the joint indicated at 56. This joint also connects the lever 62 with the brake shoe, and the lever 62 is pivoted to the side frame as shown in FIG. 1, thereby providing for vertical and lateral support of the brake shoe in the proper position to contact the wheel. A link 57 extends generally horizontally longitudinally of the truck from the lower end of the upright lever 55 and, in turn, is connected with one end of the transverse lever 58 which is pivotally mounted at 59 (See FIG. 2) to a downwardly projecting portion 60 of a frame transom as appears in FIG. 2. The other end of the lever 58 is connected by the link 61 (see FIG. 4) with the lower end of the upright brakeapplying lever **62*a* on which the brake shoe 51 at the other side of the truck is mounted in the same general manner as the shoe 49 is mounted on the lever 55. The lever 62*a*, however, is preferably pivotally mounted on the adjacent side frame member, for instance, in the manner shown for the lever 62*a* for the other wheelset appearing toward the right of FIG. 1**.

The arrangement of various of the parts of the brake mounting and operating mechanisms will be clear from comparison of the corresponding brake mounting parts at the two ends of the truck as shown in FIGS. 1, 2 and 4.

Similar brake parts are provided in the interconnection of the cylinder 48 with the brake shoes 52 and 50 for the other wheelset.

Wheel sanders 63 may be provided as shown in FIG. 1, and in a truck embodying the steering arms are preferably mounted on a portion of the steering arms, for instance, on the transverse beams 34 above referred to. In the retrofitting of a known truck, it is preferred to relocate the sanders from mounting on a portion of the truck frame to a mounting on a portion of the steering arms.

Four damper devices such as indicated at 64 are also desirably applied, for instance, two at each end of the truck between portions of the main frame and portions of the steering arms, as clearly shown in FIG. 1. These damper devices are connected to the frame and steering arms by flexible joints adapted to accommodate the relative angling motions of the steering arms. These dampers serve to control the vertical, roll and pitching motions of the locomotive car body and the truck frame. It should be noted that four dampers are shown rather than the customary two only at diagonally opposite corners of the main truck frame. The two additional dampers are needed in large part because pedestal/bearing box friction is eliminated by the use of steering arms. It should also be noted that the combination of steering arms and four dampers will improve the locomotive ride quality because pedestal/bearing box friction varies widely and is often not adequate to control ride. This friction also can cause unwanted wheel lift under full power conditions, adding to the derailment hazard.

DETAILED DESCRIPTION OF FIGS. 5, 6 AND 7

The embodiment of the self-steering mechanism shown in FIGS. 5, 6 and 7, although differing structurally from the embodiment of FIGS. 1 to 4, is also capable of being used in a retrofitting operation on a truck of the same kind as referred to above in connection with the description of FIGS. 1 to 4. The mechanism of FIGS. 5, 6 and 7 is also capable of use in newly constructed trucks of various forms. This arrangement offers the potential for employing stronger steering arms which can accommodate the motor nose suspension forces and even completely support the traction motor.

It is first noted that in FIG. 5, the truck side frame member shown and identified by the numeral 16 is of the same general configuration as the truck side frames of the truck being retrofitted in the first embodiment. However, in FIGS. 5, 6 and 7, the frame and various other parts are shown in much more simplified or diagrammatic fashion; and in addition, many components of the truck shown in FIGS. 1 to 4 have been completely omitted from the illustrations in FIGS. 5, 6 and 7. It is to be understood that the following description of the second embodiment is given with respect to the showing in FIGS. 5, 6 and 7, even though those figure numbers are not specifically referred to.

As in the first embodiment, the steering arms of the second embodiment also comprise yoke structures surrounding the wheelsets and motors. The wheels are indicated by the numeral 24 and the axle of each wheelset is here diagrammatically indicated at 65, the motors being shown in dotted outline at 27, as in the first embodiment. The wheels are again shown as riding upon the rails 25.

The yoke comprising each steering arm is indicated at 66. Here, the yoke is positioned with its side legs underlying the journal bearings 67 and is fastened to the journal bearings, for instance, as diagrammatically indicated at 68.

In this embodiment, the load is also transmitted from the side frames to the journal bearings by means of springs, in this instance comprising helical springs 69; and it will be noted that clearance is again provided in the pedestal jaws so that the yaw and other relative angular motions may occur without undesirable restriction. It should also be understood that with the stronger steering arms, the springs could be located alongside the axle boxes and the weight could be carried from the springs to the bearing boxes through the steering arms.

In this second embodiment, the interconnection between the steering arms takes a different structural form which permits using the space in the center of the truck for secondary suspension parts such as leaf springs or for other purposes. However, as in the first form, the interconnection means provides freedom for relative pivotal motion of the steering arms and thus of the wheelsets in the yawing sense, but instead of employing a centrally located ball or pivot joint, the two steering arms are pivotally interconnected with a centrally located intermediate member or plate 70. Each steering arm 66 is connected with the plate 70 by a pivot joint diagrammatically indicated at 71. The plate 70 is suspended from the main truck framing by means of upright connecting rods 72. These rods have flexible joints 73 at their upper ends suspending the rods from the main truck framing and further have flexible joints 74 at their lower ends connecting the rods with the plate 70. Because of this arrangement, the connecting plate 70 has freedom for motion laterally in a horizontal plane. Yaw motion of the plate is prevented by the pair of guide rods 75. Thus, the relative motions of the steering arms which are connected with the plate by the flexible joints 71 are constrained in the same manner as would be the case if they were connected directly to one another as by a pivot joint 37 in the first embodiment.

In view of the arrangement just described, traction forces are communicated from steering arms to the central plate 70. Those forces are, in turn, communicated to the main frame structure also by means of the rods 75, one disposed toward each side of the truck frame and being connected at one end by flexible joints 76 with brackets 77 which, in turn, are connected with the truck side frames. The other ends of the rods 75 have flexible joints 78 serving to connect the rods with the brackets 79 which are mounted on the plate 70. Thus, the plate 70 acts to interchange steering forces between the two steering arms and to carry traction forces from the steering arms to the truck frame.

Torque forces are communicated between the motor 27 and the steering arm of each wheelset by means of spaced abutment lugs 80, one projecting from the motor above the steering arm and the other projecting from the motor below the steering arm, as shown in FIG. 5. The torque forces are communicated to the plate 70 and from that plate through the links 72 to the rigid truck frame. It can be visualized that the motor could be supported entirely by extending the motor 27 in the region 87 and providing for connection to the steering arm cross member 82 mentioned herebelow.

It is further contemplated to employ generally horizontal links 81 at opposite ends of the truck, each link providing for interconnection of the adjacent steering arm and the adjacent transom of the truck frame, the latter being indicated at 82. Flexible connections 83 and 84 at the ends of each link 81 are associated with brackets 85 and 86 which are mounted respectively on the adjacent steering arm 66 and on the adjacent transom 82.

Because of the links 81, the relative yawing motions of the two steering arms are accompanied by transverse motion of the interconnecting plate 70 with which the steering arms are joined by the flexible connections 71. This transverse motion is similar to that of pivot 37 in the first embodiment.

It is to be understood that a variety of car body/truck interconnections could be used with bolster means such as illustrated and described in connection with the first embodiment are present in the event that the truck of FIGS. 5, 6 and 7 is being retrofitted to an existing truck structure, as referred to in FIGS. 1, 2, 3 and 4. Other parts and devices will, of course, also be used, including for example brakes arranged as described above in relation to FIGS. 1 to 4, but various of these additional parts are not shown and described in detail with reference to the embodiments of FIGS. 5, 6 and 7.

It will be noted that in FIGS. 5 and 7, certain distances are marked, being identified by the letters a and b. The distance a represents the spacing from the center of the axle to the point of connection 71 of the steering arm with the plate 70. This spacing should be the same for each of the two motorized wheelsets, but the spacing b between the pivot joints 71 for the two steering arms may be different from the spacing a and is not critical. It is further noted that with distance b made approximately equal to *2a*, the embodiment can be used on a three-axle truck with the third motor/axle assembly moving laterally with plate 70.

CONCLUSION

The foregoing description of the two embodiments shown in the drawings discloses novel arrangements for providing a self-steering function in multiple axle powered locomotive trucks. This results in greatly increased accuracy of tracking of the wheels, with consequent extensive increase in wheel adhesion. This not only eliminates undesirable wheel flange/rail forces on curved track and also virtually eliminates high-speed hunting, with the resultant excessive wear on both road bed and trucks, but in addition, these various improvements in the operation of the powered truck result in greatly increased traction available from a given input of power.

I claim:

1. A powered railway truck adapted for use under the body of a locomotive, comprising:

(a) truck framing including side frames having pairs of pedestal jaws for accommodating journal bearings of at least two axled wheelsets, (b) at least two axled wheelsets each comprising an axle and a pair of wheels fixed on its axle, (c) a pair of journal bearings for each axle, the journal bearings for each axle being received in a pair of pedestal jaws each having clearance providing freedom for yaw motion of the wheelsets with respect to the truck framing and with respect to each other, (d) means in the mid region of the truck framing for mounting the truck under the body of the locomotive comprising a truck swivel joint for interconnecting the truck framing with the body of the locomotive and providing freedom for swivel motion of the truck as a whole with respect to the body of the locomotiove about an upright swivel axis between the axled wheelsets, (e) at least one of the axled wheelsets being powered by a driving motor mounted thereon and having motor torque recation means connected to the truck framing, the motor torque reaction means being yieldable to accommodate yaw motion of the wheelset with respect to the truck framing, (f) a steering arm for each wheelset, each steering arm being connected with both of the journal bearings for the associated wheelset and movable therewith in yaw within the clearance provided in the associated pair of pedestal jaws, the steering arms being extended from the journal bearings into the central region between the wheelsets and between the sides of the truck, (g) abutment means in the region of the centerline of the truck for transmitting tractive force from the steering arm of any powered wheelset to the truck framing, (h) mechanism pivotally interconnecting the steering arms, including pivot means having an upright pivot axis in said central region between the wheelsets and between the sides of the truck and having means providing for relative yawing motion and means providing for relative rolling motion of the wheelsets with their respective steering arms, said pivot means being shiftably movable laterally of the vehicle independently of the vehicle body and independently of the truck framing, (i) and mechanism interconnecting each steering arm and the truck framing in the region between the wheelset and the adjacent end of the truck framing, each such mechanism including means providing restraint for relative movement of the steering arm and said adjacent end of the truck framing laterally of the truck, and further including means providing freedom for rolling motion of the steering arm with respect to the truck framing and for lateral shifting movement of the pivot means interconnecting the steering arms.

2. A powered railway truck as defined in claim 1 in which said pivot means of the mechansim pivotally interconnecting the steering arms comprises a single upright pivot joint directly interconnecting the steering arms in an upright plane midway between the wheelsets.

3. A powered railway truck as defined in claim 1 in which the mechanism pivotally interconnecting the steering arms includes a connection element intermediate the steering arms and in which the pivot means comprises separate upright pivots interconnecting the steering arms with said connection element at points spaced from each other longitudinally of the vehicle, and means enforcing substantially equal and opposite pivotal motion of the steering arms with respect to said element.

* * * * *